US005553437A

United States Patent [19]

Navon

[11] Patent Number: 5,553,437

[45] Date of Patent: Sep. 10, 1996

[54] STRUCTURAL BEAM

[76] Inventor: Ram Navon, 1347 Alta Vista #11, Los Angeles, Calif. 90046

[21] Appl. No.: 238,213

[22] Filed: May 3, 1994

Related U.S. Application Data

[63] Continuation-in-part of Ser. No. 948,389, Sep. 21, 1992, which is a continuation-in-part of Ser. No. 674,549, Mar. 22, 1991, abandoned, which is a continuation-in-part of Ser. No. 518,554, May 3, 1990, abandoned.

[51] Int. Cl.[6] ..... E04C 3/30

[52] U.S. Cl. ..... 52/729.1; 52/730.6; 52/731.1; 52/731.7

[58] Field of Search ..... 52/729, 730.1, 52/730.4, 730.6, 731.1, 731.2, 731.4, 731.7, 732.1, 732.3

[56] References Cited

U.S. PATENT DOCUMENTS 1,360,720 11/1920 Brown et al. .
2,082,792 6/1937 Dean .
3,698,224 10/1972 Saytes .

FOREIGN PATENT DOCUMENTS 1372095 10/1974 Belgium .
1408312 7/1965 France .
2269618 11/1975 France .
1476324 6/1972 United Kingdom .

*Primary Examiner*—Lanna Mai
*Attorney, Agent, or Firm*—Cushman Darby & Cushman, L.L.P.

[57] ABSTRACT

A fabricated structural beam includes at least one longitudinally folded member having a web portion and a head portion. In different embodiments, a plurality of folded members may be interleaved with one another to provide configurations of varying load carrying capabilities. In all cases, the folded head portion is made rigid by forming it into a tube that is closed on all sides.

9 Claims, 6 Drawing Sheets

STRUCTURAL BEAM

This is a continuation-in-part application of application Ser. No. 07/948,389 filed Sept. 21, 1992, which in turn is a continuation-in-part of application Ser. No. 07/674,549, filed Mar. 22, 1991, now abandoned, which application is a continuation-in-part of application Ser. No. 07/518,554 filed May 3, 1990, now abandoned.

FIELD OF THE INVENTION

This invention relates to the field of structural building materials, and more particularly to a fabricated structural beam.

BACKGROUND OF THE INVENTION

A variety of types of structural beams are used in non-residential construction. Some examples include fabricated wooden girders, laminated wood beams, and reinforced concrete beams. By far, the most commonly used material is structural steel of various cross sections, such as "I"-section, "H"-section, "C"-section, "Z"-section, and channel section. These structural steel shapes are most commonly manufactured by hot or cold rolling processes and generally provide a relatively heavy beam for a given load carrying capacity.

Structural sections fabricated from sheet steel are used in some construction applications. For example, it is now a common practice to utilize fabricated steel studs, particularly in non-residential construction. These are generally made from galvanized steel sheet, cold-rolled into a "C"-section or channel section. Furthermore, corrugated or fluted steel sheets are widely used in flooring and roofing applications.

Certain other fabricated structural shapes are known in the prior art. For example, FIG. 1 illustrates a prior art structural shape fabricated from sheet steel. Beam 1 comprises a web portion 2 and opposing head portions 3 and 4. As can be clearly seen in the illustration, beam 1 can be easily fabricated from a single flat sheet of steel by rolling or otherwise folding the sheet longitudinally. It should be noted that edges 5 and 6 of the sheet are folded back towards web portion 2, but are not fastened or otherwise secured thereto. A prior art beam such as beam 1 has a very limited load bearing capability.

It is one of the objects of the present invention to provide a fabricated structural beam that has a load carrying capability comparable to that of conventional hot or cold rolled structural steel sections, but which is light in weight compared to a conventional section of equal load carrying capability.

SUMMARY OF THE INVENTION

The fabricated structural beam of the present invention comprises at least one longitudinally folded member having a web portion and a head portion. In different embodiments, a plurality of folded members may be interleaved with one another to provide configurations with varying load carrying capabilities. In all cases, the folded head portion is made rigid by forming it into a tube that is closed on all sides. Embodiments of the invention fabricate the head portions of the beam from individual longitudinal members.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details.

Figure 1:
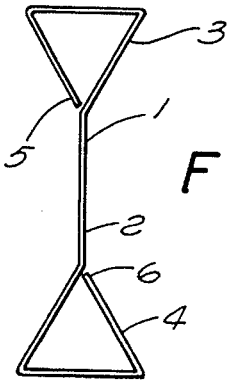
FIG. 1 PRIOR ART
FIG. 1 is a cross sectional view of a prior art fabricated structural beam.
Figure 2:
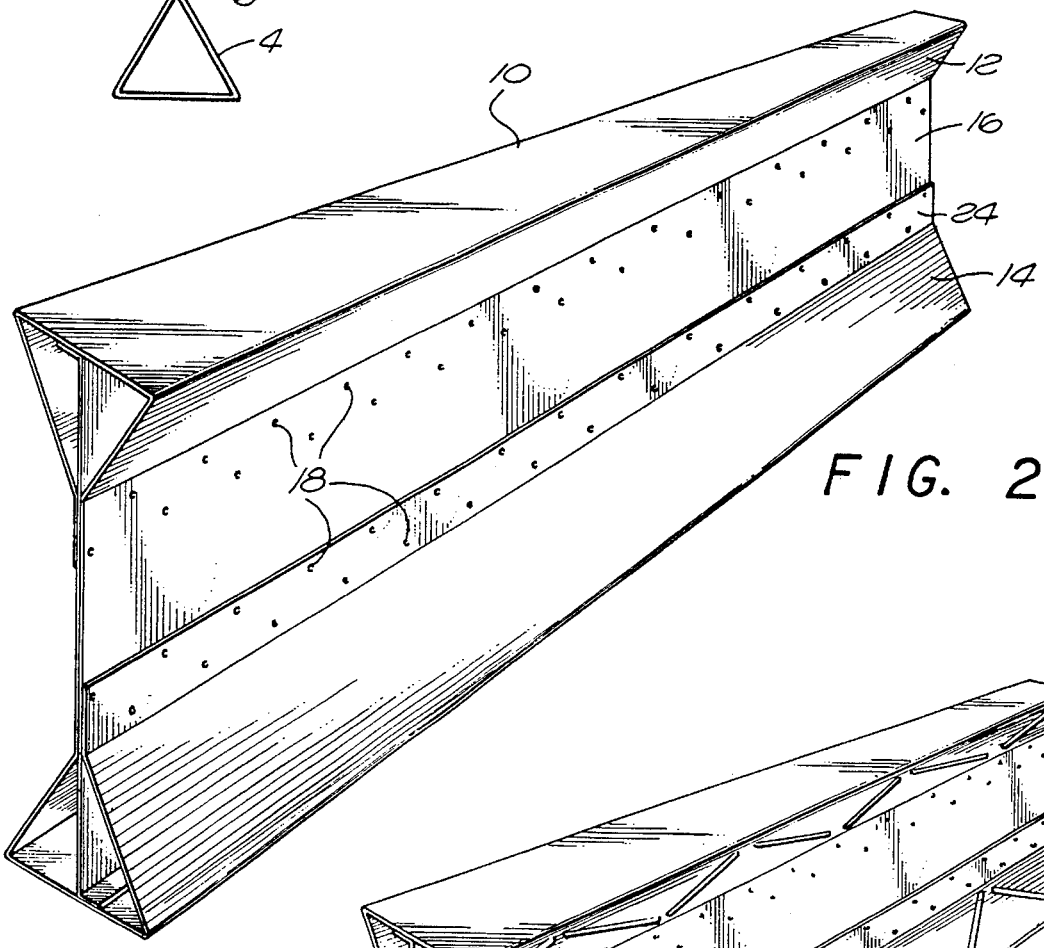
FIG. 2 is perspective view of a preferred embodiment of a fabricated structural beam according to the present invention.
Figure 3:
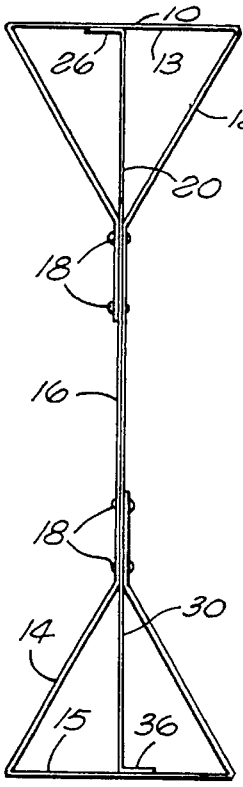
FIG. 3 is a cross sectional view of the beam shown in FIG. 2.

Referring first to FIGS. 2 and 3, a preferred embodiment of the present invention will be described. Beam 10 comprises a pair of triangularly shaped head portions 12 and 14 joined together by web portion 16. In overall configuration, beam 10 is thus similar to a conventional "I" beam. However, unlike a conventional structural beam, beam 10 is fabricated from relatively thin gauge sheet material. In most applications, beam 10 will be built up from cold rolled sheet steel. However, it is to be understood that the present invention is not limited to such a choice of material, but may be constructed from any suitable malleable sheet material. In particular, certain applications may recommend the use of aluminum or even a plastic.

Figure 4A:
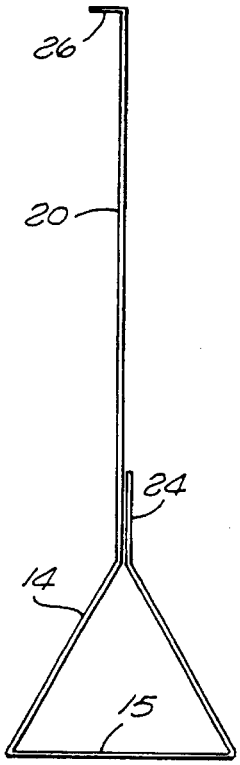
FIGS. 4*a, b* illustrate the individual folded members used to construct the beam illustrated in FIGS. 2 and 3.
Figure 4B:
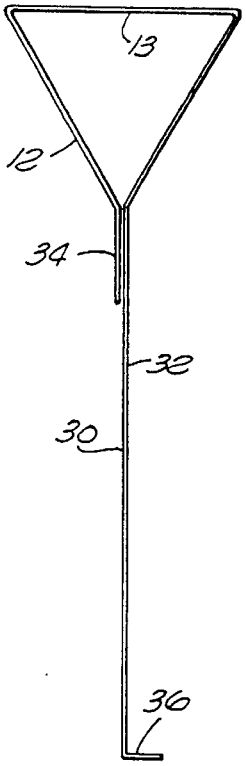

The construction of beam 10 can best be understood with reference to FIGS. 4*a* and 4*b* which illustrate the individual members 20 and 30 that are interleaved to form beam 10. Member 20 is folded longitudinally and comprises a web portion 22, triangular head portion 14, web flange 24 and tail flange 26. In the illustrated embodiment, member 30 is identical to member 20, but need not be so. Members 20 and 30 are interleaved such that web portion 22 of member 20 extends between web portion 32 and web flange 34 of member 30. Likewise, web portion 32 of member 30 extends between web portion 22 and web flange 24 of member 20. Tail flange 26 of member 20 abuts wall 13 of triangular head portion 12. Likewise, tail flange 36 of member 30 abuts wall 15 of triangular head portion 14.

It is preferable that the cross-section of head portions 12 and 14 be substantially equilateral triangles. However, the invention is not limited in this regard.

Members 20 and 30 are secured to one another by fastening means 18. Fastening means 18 may comprise conventional mechanical fasteners, such as rivets or screws. Fastening means 18 may also comprise other conventional fastening means, such as spot welding or adhesives. The preferred embodiment utilizes a fastening technique sold under the trademark TOX by Pressotechnik, GMBH and its licensees. This technique employs a stamp and die to join together two or more thicknesses of material in a cold extrusion forming process. The TOX process is particularly advantageous for use with the present invention since it is fast, does not employ consumable fasteners and does not rupture anti-corrosion coatings.

Web portion 16 of fabricated beam 10 comprises two thicknesses of material. For applications requiring a greater web thickness, either or both of web flanges 24 and 34 may be extended such that web portion 16 comprises three or four thicknesses of material.

Beams of the present invention, such as beam 10, may be conveniently fabricated by a continuous process wherein coils of sheet steel are fed through a suitable arrangement of rollers to impart the desired longitudinal folds and simultaneously interleave the members. The fabricated beam then passes through an array of mating stamp and die sets to fasten the members together at suitable intervals. The length of the completed beam is not inherently limited by such a process, and thus beams of any practical length can be readily manufactured. Moreover, the arrangement of rollers can be relatively easily altered to produce beams of differing transverse dimensions. The manufacturing process also easily accommodates sheet materials of different thicknesses so that the load capacity of the manufactured beam may be selected for each lot produced. For relatively large construction projects, suitable equipment may be located at the job site to produce beams according to the present invention in a manner somewhat analogous to that used for on-site fabrication of residential gutters.

Figure 5:
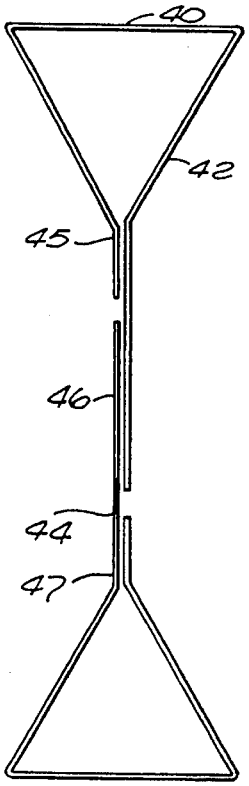
FIG. 5 illustrates another embodiment of the present invention.
Figure 6:
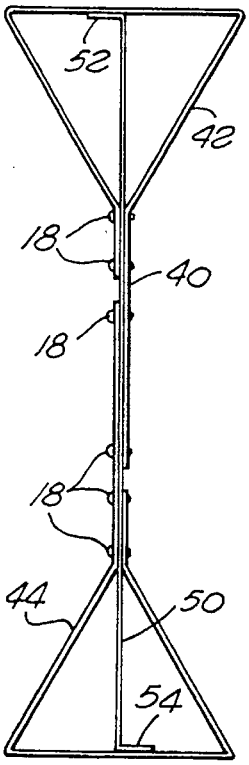
FIG. 6 illustrates a modification of the embodiment shown in FIG. 5.

Referring next to FIG. 5, another embodiment of the present invention is illustrated. Here, beam 40 comprises members 42 and 44. These members may be fastened together at locations 45, 46 and 47 as shown in FIG. 5; however, it is preferable to insert a third member 50 between members 42 and 44 as shown in FIG. 6. Insert 50 includes tail flanges 52 and 54 that abut against the respective triangular head portions of members 42 and 44. Members 42, 44 and 50 are fastened together by fastening means 18 as described above. The resulting structure of beam 40 is quite similar to that of beam 10 as illustrated in FIG. 3, except that the web portion comprises three thicknesses of material. This embodiment has the particular advantage that member 50 may be made of a heavier gauge material than members 42 and 44, thereby imparting additional strength to beam 40 without necessarily increasing the thickness of material in the head portions of the beam. It should be noted that member 50 may comprise a conventional "I" beam or other conventional steel section where substantial reinforcement is desired. Member 50 need not be inserted over the entire span of beam 40, but may be inserted only in certain longitudinal regions requiring additional reinforcement.

Figure 7:
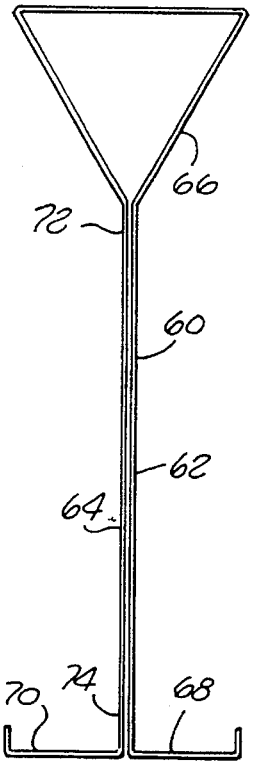
FIG. 7 illustrates yet another embodiment of the present invention.
Figure 8:
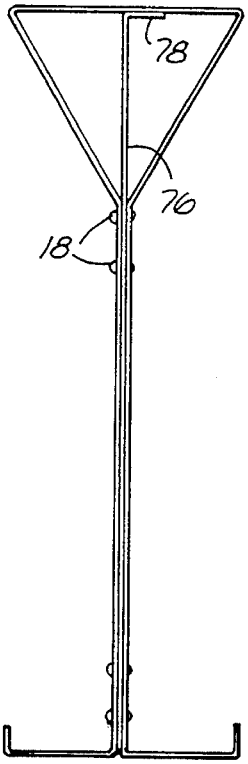
FIG. 8 illustrates a modification of the embodiment shown in FIG. 7.

Still another embodiment of the present invention is illustrated in FIG. 7. Beam 60 comprises a single longitudinally folded member having parallel web portions 62 and 64, head portion 66 and opposing tail flanges 68 and 70. This embodiment can be utilized as illustrated in FIG. 7 by fastening web portion 62 and 64 together at locations 72 and 74. However, it is preferable to add a second longitudinal member 76 as shown in FIG. 8. Member 76 includes tail flange 78 that abuts head portion 66. As with the other embodiments thus far described, web portion 62 and 64 and member 76 are secured by fastening means 18. As with the embodiment illustrated in FIG. 6, member 76 may be of the same or a heavier gauge than the remainder of the beam.

Figure 9:
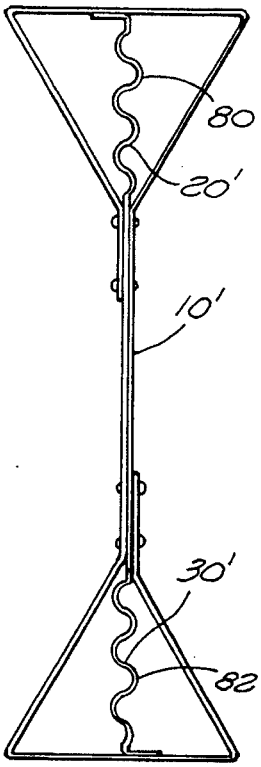
FIG. 9 illustrates still another embodiment of the present invention.

Referring now to FIG. 9, a modification of the embodiment illustrated in FIGS. 2 and 3 is shown. In this embodiment, members 20' and 30' are essentially identical to members 20 and 30 previously described except for corrugations 80 and 82. These corrugations are added to provide additional stiffness in beam 10'.

Figure 10:
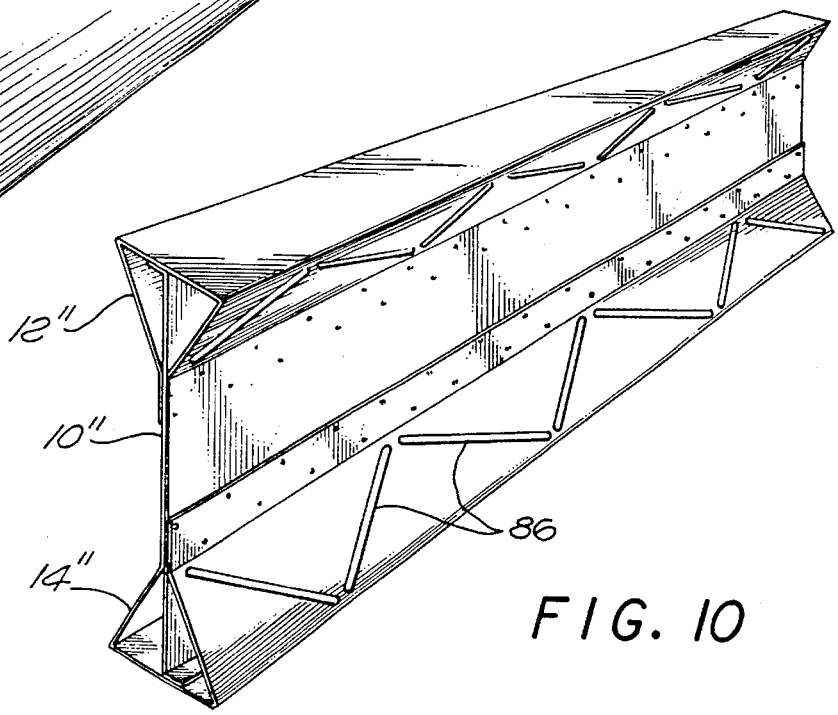
FIG. 10 illustrates yet a further embodiment of the present invention.

In a similar manner, FIG. 10 illustrates a further modification of beam 10 as shown in FIGS. 2 and 3. Beam 10" includes embossed ribs or corrugations 86 on the sloping walls of head portions 12" and 14". It will be understood that other patterns of corrugations and other means of reinforcement may be incorporated with any of the embodiments described herein.

Figure 11:
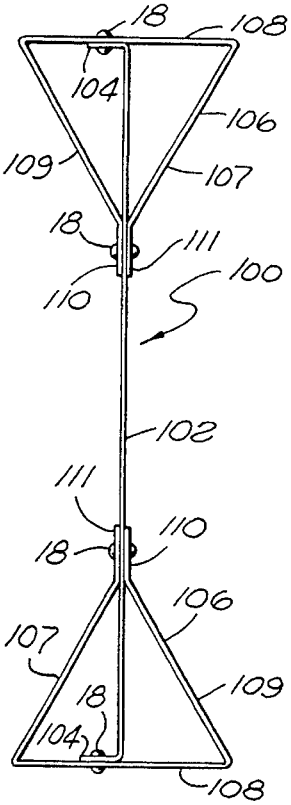
FIG. 11 illustrates an additional embodiment of the present invention.

With reference now to FIG. 11, yet another embodiment of the present invention is shown. Beam 100 is constructed in a manner essentially similar to the embodiments described above. However, this design offers significant advantages as will be described below.

Beam 100 comprises web member 102, which includes tail flanges 104 at each end. Beam 100 also comprises a pair of identical head members 106. Each of head members 106 is folded approximately in the shape of an equilateral triangle having sides 107, 108 and 109. Side 109 terminates with web flange 110 and side 107 terminates with web flange 111 in like manner. Flanges 104 of web member 102 are secured to sides 108 of head members 106 by means of fasteners 18. Likewise, tail flanges 104 of web member 102 are secured to sides 108 of head members 106 by means of fasteners 18. As discussed in connection with the previously described embodiments, fasteners 18 may be any suitable form of fastener. However, in this embodiment, the TOX fastening system is not preferred because of the difficulty of positioning a dye within the triangular head members. More suitable fastening means for this embodiment are rivets or spot welding.

In beam 100, shear and bearing loads are carried by sides 107 and 109 of head members 106 and also by web member 102. By fastening the web member flanges 104 to head member sides 108, greater flexural strength is achieved in comparison to the beams described above. Moreover, web member 102 of this embodiment increases the buckling strength of the head members. The thickness of web element 102 may be selected to achieve any desired beam strength. It is to be noted that this selection may be independent of the selected thickness of head members 106, thereby allowing the structural characteristics of beam 100 to be optimized for particular applications.

Figure 12A:
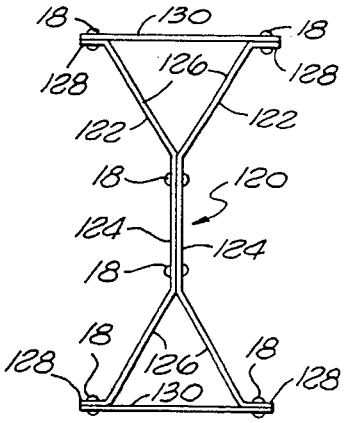
FIGS. 12*a*–12*e* illustrate variations on an embodiment of the present invention having fabricated head structures.

FIGS. 12*a*–12*e* illustrate further variations of structural beams within the scope of this invention. Referring first to FIG. 12*a*, the basic characteristics of this design will be described with equal applicability to the variations shown in FIGS. 12*b*–12*e*. Beam 120 comprises a pair of identical web members 122. Each of web members 122 has a center section or portion 124, outwardly angled intermediate portions or legs 126, and flange portions or mounts 128. Web members 122 are attached to one another at their respective center portions 124 by means of fasteners 18.

Beam 120 further comprises plate or head members 130 secured to respective flange portions 128 of the web members, also by means of fasteners 18. Beam 120 differs from all of the previously described beams in that the triangular head structures are not folded from a single sheet of material, but rather are fabricated from individual elements, namely, intermediate portions 126 of web members 122 and head members 130. These elements define a tubular structure with a generally triangular cross-section as in all other embodiments described thus far.

Figure 12B:
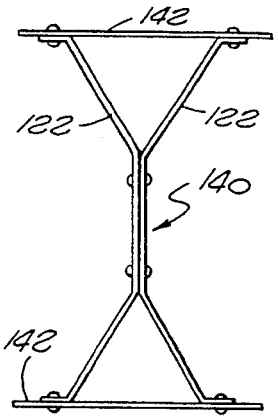
Figure 12C:
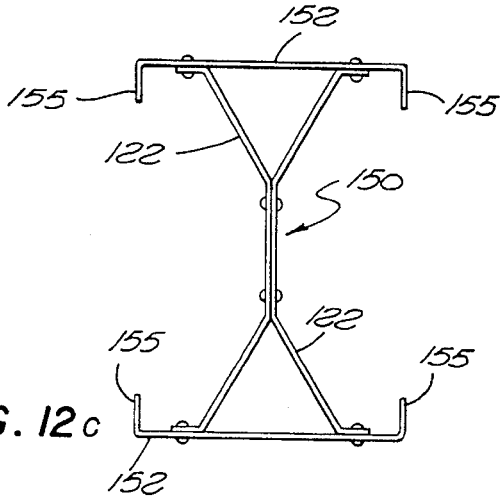
Figure 12D:
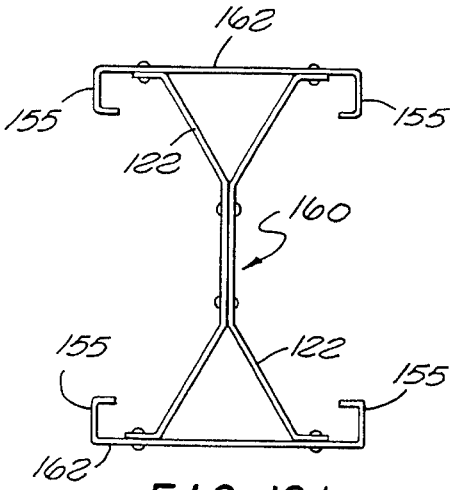
Figure 12E:
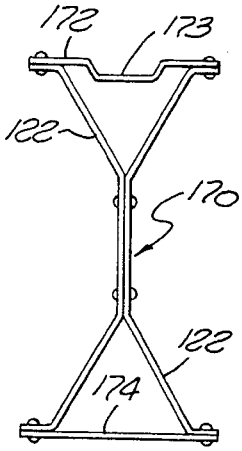

Beam 140 illustrated in FIG. 12*b* is essentially identical to beam 120, but employs extended head members 142. Beam 150 shown in FIG. 12*c* is again essentially identical to beam 120 but employs channel shaped head members 152 including opposite side edges bent toward the other plate member with said plate members having the same width dimension. FIG. 12*d* illustrates a beam 160 wherein head members 162 have a "C"-section. FIG. 12*e* shows beam 170 in which head member 172 includes a longitudinal depression 173 that serves as a stiffening element. Head member 174 is shown as a simple plate identical to head members 130 of beam 120. However, it is to be understood that head member 174 could be identical to head member 172. In fact, any combination of head members can be utilized with the basic structure comprising web members 122 to accommodate special applications.

By virtue of flange elements 128 of the various embodiments illustrated in FIGS. 12*a*–12*e*, these beams are particularly well suited for fastening horizontal collateral elements, such as floors or ceilings, from either the top or bottom of each flange. By virtue of vertical flange elements 155, beams 150 and 160 are further adapted for fastening vertical collateral elements, such as partitions, wallboard, or window wall directly to the beam. Moreover, vertical flange elements 155 facilitate fastening beams 50 and 160 from the side to conventional strap hangers and the like. As in all of the previously described embodiments, the thickness of the individual members of these beams may be selected to achieve virtually any desired structural characteristics. The beams illustrated in FIGS. 12*a*–12*e* offer the particular advantage of being more economical to manufacture, partly due to the fact that obtuse folds of material are not required.

It will be recognized that the above described invention may be embodied in other specific forms without departing from the spirit or essential characteristics of the disclosure. Numerous variations will be apparent to persons skilled in the art of structural design. For example, while the embodiments discussed above are most advantageously constructed of cold-rolled sheet steel, a hot rolling process may be employed in certain applications. In particular, it should be noted that cold rolled and hot rolled sections may be combined as discussed above in connection with FIG. 6. Furthermore, because of the open nature of the beams of the present invention, a plurality of such beams may be "nested" within one another to provide a greater load bearing capability than a single such beam without increasing the gauge of sheet material used.

To illustrate the advantages of the present invention, the following tables compare the calculated performance of a test section comprising the embodiment illustrated in FIGS. 2 and 3 with various standard structural shapes. In each of the following tables, the beam of the present invention has a height of 200 millimeters and a width of 60 millimeters. Results for three material thickness are presented, namely 1.0 millimeter, 1.2 millimeter, and 1.6 millimeter. All results are for standard sections of hot rolled British grade 43C steel, which is generally equivalent to ASTM A36.

In the following tables, Columns (a), (b), and (c) give the mass per meter, cross sectional area and moment of inertia for the sections respectively. Column (d) gives the load considered for deflection purposes, $W_D$, based on the design criterion that the maximum deflection should be less than 1/360th of a beam length of 3 meters. Column (e) gives the load ratio with respect to the test section. Column (f) gives the maximum span for each section when the point load equal to WD for the test section is applied to the simply-supported beams. Column (g) gives the maximum span ratio with respect to the test section.

TABLE 1

| Section | (a) Mass/ Length (kg/m) | (b) Cross-Sectional Area × $10^{-3}$ ($m^2$) | (c) Moment of Inertia × $10^{-6}$ ($m^4$) | (d) $W_D$ (kN) | (e) Maximum Load Ratio | (f) Maximum Span (m) | (g) Maximum Span Ratio |
|---|---|---|---|---|---|---|---|
| Test section 200 mm × 60 mm thickness = 1.0 mm | 5.64 | 0.718 | 3.4670 | 10.790 | 1.0 | 3.000 | 1.0 |
| Channel section 76 mm × 38 mm web thickness = 5.1 mm flange thickness = 6.8 mm | 6.70 | 0.853 | 0.7414 | 2.310 | 0.21 | 1.387 | 0.46 |
| Square hollow section 60 mm × 60 mm wall thickness = 3.2 mm | 5.67 | 0.722 | 0.3870 | 1.204 | 0.11 | 1.002 | 0.33 |
| Rectangular hollow section 80 mm × 40 mm wall thickness = 3.2 mm | 5.67 | 0.722 | 0.5810 | 1.810 | 0.17 | 1.228 | 0.41 |

TABLE 2

| Section | (a) Mass/ Length (kg/m) | (b) Cross-Sectional Area × $10^{-3}$ ($m^2$) | (c) Moment of Inertia × $10^{-6}$ ($m^4$) | (d) $W_D$ (kN) | (e) Maximum Load Ratio | (f) Maximum Span (m) | (g) Maximum Span Ratio |
|---|---|---|---|---|---|---|---|
| Test section 200 mm × 60 mm thickness = 1.2 mm | 6.764 | 0.8616 | 4.194 | 13.05 | 1.0 | 3.000 | 1.0 |
| Channel section 76 mm × 38 mm web thickness = 5.1 mm flange thickness = 6.8 mm | 6.700 | 0.853 | 0.7414 | 2.31 | 0.18 | 1.261 | 0.42 |
| Square hollow section 60 mm × 60 mm wall thickness = 4.0 mm | 6.97 | 0.888 | 0.4610 | 1.43 | 0.11 | 0.995 | 0.33 |
| Rectangular hollow section 80 mm × 40 mm wall thickness = 4.0 mm | 6.97 | 0.888 | 0.6960 | 2.17 | 0.17 | 1.222 | 0.41 |

TABLE 3

| Section | (a) Mass/ Length (kg/m) | (b) Cross-Sectional Area × $10^{-3}$ ($m^2$) | (c) Moment of Inertia × $10^{-6}$ ($m^4$) | (d) $W_D$ (kN) | (e) Maximum Load Ratio | (f) Maximum Span (m) | (g) Maximum Span Ratio |
|---|---|---|---|---|---|---|---|
| Test section 200 mm × 60 mm thickness = 1.6 mm | 9.02 | 1.1488 | 5.714 | 17.78 | 1.0 | 3.000 | 1.0 |
| Channel section 102 mm × 51 mm web thickness = 6.1 mm flange thickness = 7.6 mm | 10.42 | 1.3280 | 2.0770 | 6.46 | 0.36 | 1.809 | 0.60 |
| Square hollow section 80 mm × 80 mm wall thickness = 3.6 mm | 8.59 | 1.0900 | 1.0600 | 3.30 | 0.19 | 1.292 | 0.43 |
| Rectangular hollow section 100 mm × 50 mm wall thickness = 4.0 mm | 8.86 | 1.1300 | 1.4200 | 4.42 | 0.25 | 1.495 | 0.50 |
| "I" section 254 mm × 102 mm web thickness = 5.8 mm flange thickness = 6.8 mm | 22.0 | 2.8400 | 28.670 | 89.19 | 5.02 | 6.72 | 2.24 |
| "Z" section 76.2 mm × 69.85 mm thickness = 6.35 mm | 9.99 | 1.2710 | 1.195 | 3.72 | 0.21 | 1.37 | 0.46 |

When a section of the present invention is compared with standard sections of similar mass per meter, its moment of inertia is significantly larger than that of the other sections. Thus, it supports more loading compared with the standard sections. Similarly, it spans longer than the standard sections for the same maximum deflection.

Figure 13A:
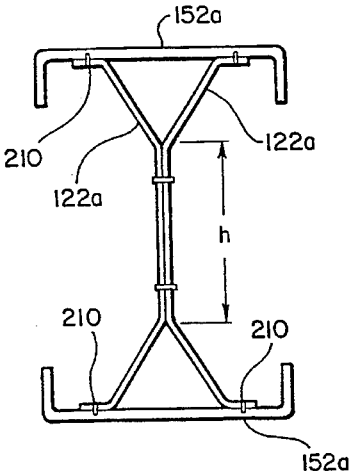
FIGS. 13*a*–13*f* illustrate an embodiment similar to that of FIG. 12*c*.
Figure 13B:
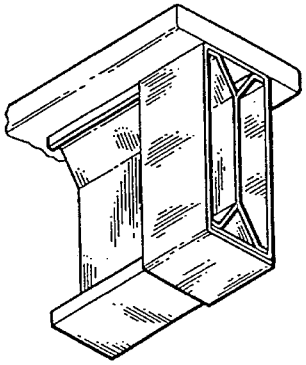

Now referring to FIG. 13*a*, a variation of the embodiment of FIG. 12*c* may be seen. Here flanges 152*a* are still preferably roll formed with preferably 90° lips, though are intentionally fabricated of thicker material than the web member 122*a*. The use of thicker material for the flanges allows the increase in the strength to weight ratio of the beam, or alternatively a reduction of the material required and simplification of the fabrication process for a given load bearing capacity. Such an embodiment is generally intended for use as a secondary frame and preferably fabricated by spot welding the parallel central portions of the webs together and by spot welding the webs in regions 210 to the flanges 152*a*. In such a beam, preferably the height of the flat facing portions of the web is at least ⅓ of the total height of the beam section, and preferably substantially larger than ⅓ so as to allow ample height for a web mount of the end of the beam. Such a beam also allows ready encasement as illustrated in FIG. 13*b* for a fire rating and/or encasement of pipes and other utilities within the enclosure defined by the encasement.

Figure 13C:
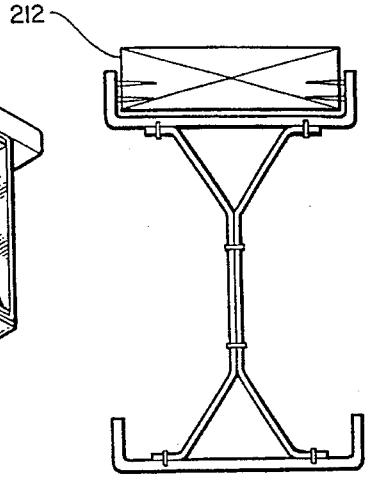
Figure 13D:
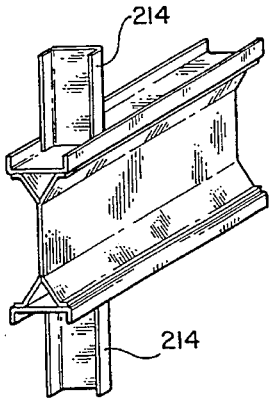
Figure 13E:
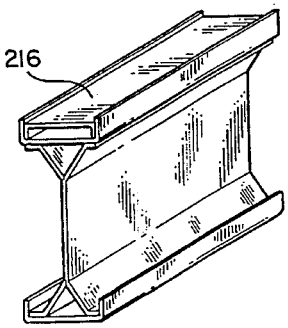

As a further alternative, the upper flange member 152*a* of FIG. 13*a* may be pierced or toothed to attach a wood nailer, with a beam being assemblable as shown in FIG. 13*c* to form a beam to which wood members such as wood flooring may be nailed by nailing to wood member 212. As a further alternative, the parts of the beam of FIG. 13*a* may be assembled with both the upper and lower U-shaped flanges facing outward as shown in FIG. 13*d*, such a construction being useful for such purposes as forming a stud wall track as one might find at the top of door openings and at the top and bottom of window openings. Here the studs 214 could be pin shot or welded to the beam as desired. Finally with only moderate variation, one of the U-shaped flanges 152*a* of the embodiment of FIG. 13*a* may be formed with a slight inward projecting lip adjacent the other edge of the U-shaped channel and assembled to the webs with the U-shaped channel facing outward. FIG. 13*b* shows such a configuration, namely with the upper channel so formed (though alternatively the other or both flanges may be so formed) with a closure member 216 snapping into the channel to form a pop-in electrical raceway for routing in protection of the wiring.

Figure 13F:
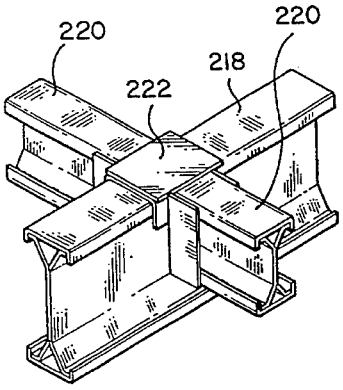

FIG. 13*f* illustrates another form of interconnection of beams in accordance with this embodiment of the invention. In particular, by way of example, in a roof construction the main load carrying beams 218, typically themselves mounted by a web mounting at the ends thereof, in turn support cross-beams or rafters 220 by saddle hangers 222 fastened to the edges of both the upper and lower flanges of the rafters 220. While as stated before, the central parallel section of the webs should have a height of at least ⅓ the total height of the beam cross section, it may be seen particularly from FIG. 13*f*, and from the examples of web support of the beams to be herein illustrated, it is more preferable for the height of the central section "h" to be at least ½ the total height of the beams, if not as much as ⅔ or more of the total height of the beams.

Figure 14A:
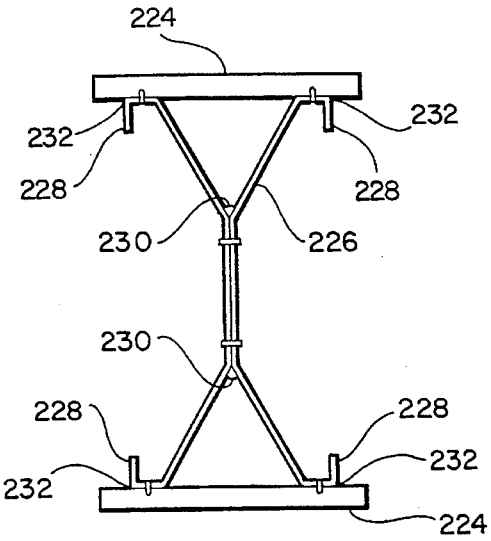
FIGS. 14*a*–14*d* illustrate embodiments similar to other specific embodiments of FIGS. 12.
Figure 14D:
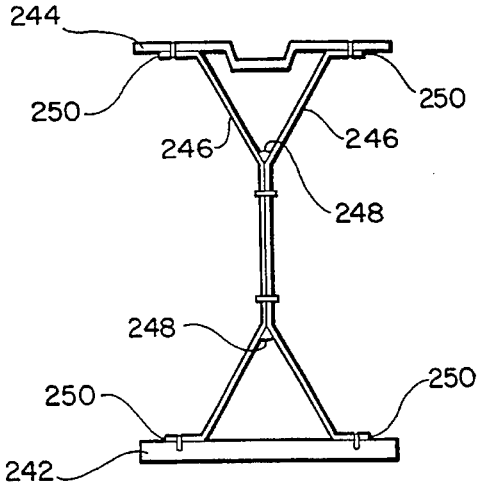
Figure 14B:
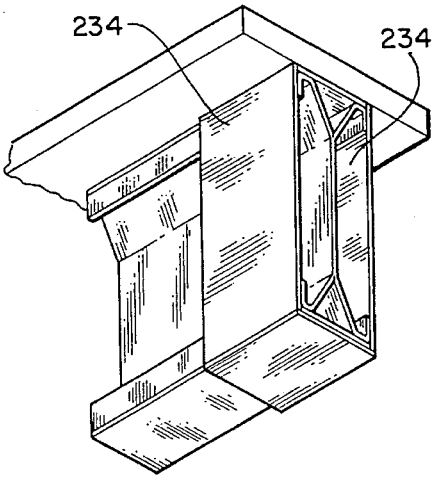
Figure 14C:
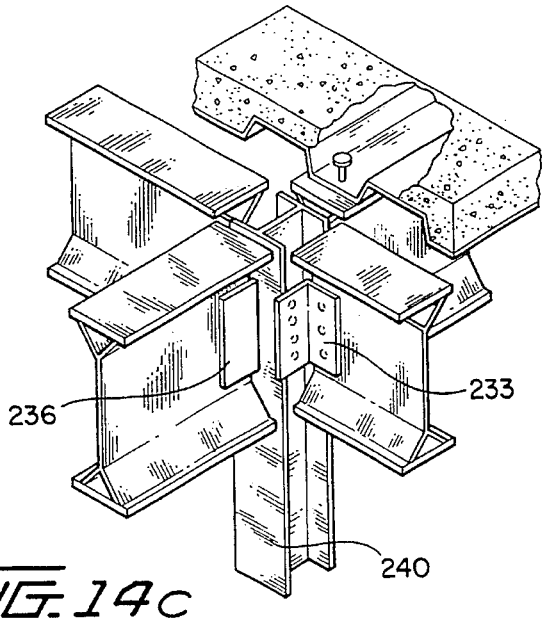

For still higher load bearing capabilities, still thicker flanges may be desired which are either impossible or impractical to roll form to a shallow channel shape. In this case, beams much like that illustrated in FIGS. 13*a*, 13*b* and 13*d* through *f* may be fabricated by using relatively thick, flat flange members 224 and web members 226 having their outward edges 228 turned toward each other as illustrated in FIG. 14*a*. Here again, the same proportions as described with respect to FIGS. 13 similarly apply, though in the embodiment of FIG. 14*a*, because of the thicker flanges, it may be preferable to continuously weld the web members to each other in regions 230 and to continuously weld the same to the flanges in regions 232. For encasement purposes, as illustrated in FIG. 14*b*, encasement members 234 may readily be fastened by screws or otherwise to the flanges 228 on the web members of FIG. 14*a* rather than the edges of the flanges as in the embodiment of FIG. 13*a*. Beams in accordance with FIG. 14*a* (as well as those of FIGS. 13) may be web mounted as illustrated in FIG. 14*c* namely by members 236 and 238 welded or bolted to the flanges of the beams and themselves welded or bolted to a supporting column such as, in FIG. 14*c*, a conventional "I" beam 240. As a still further alternate to the beams of FIGS. 14*a* through 14*c*, an embodiment similar to that of FIG. 12*e*, namely that of FIG. 14*d* may be used, this embodiment having a thick lower flange 242 and a somewhat thinner formed flange 244 which in turn is still preferably considerably thicker than the material making up the two web members 246. Flange 244 may have an embossment to assist shear transfer for composite action with the supported concrete slab. Like the embodiment of FIG. 14*a*, preferably the embodiment of FIG. 14*d* has continuous welds in region 248 and 250 to withstand the increased stress the web may be subjected to in such structures.

Figure 15A:
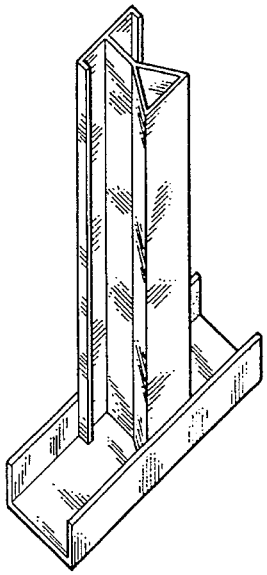
FIGS. 15*a*–15*c* illustrate embodiments similar to that of FIG. 7, and uses of such embodiments including a truss element utilizing a portion of such embodiments.
Figure 15B:
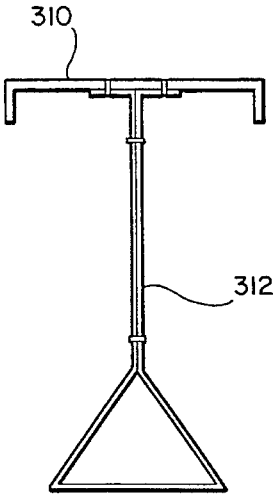
Figure 15C:
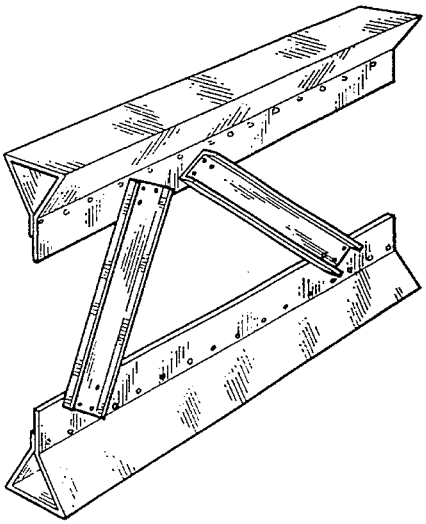

In the embodiment of FIG. 7, the beam is constructed from a single strip of sheet metal and preferably spot welded at various points along its length in regions 72 and 74 as hereinbefore described. Such a structure is highly useful as a beam, as it may be readily web supported from the ends thereof and wood, metal or other members such as wall board may readily be fastened to either the top or bottom thereof by nails, speed screws or the like. The structure is also useful in vertical orientations such as for wall studs, as illustrated in FIG. 15*a*. For higher load carrying capacities, as shown in FIG. 15*b*, flange 310 may be fabricated using a thicker sheet metal in a roll forming operation and welded to the small roll form flanges on web portion 312. Preferably the flanges on web portion 312 are spot welded to the flange 310, though continuous welds could be used if the thickness of the material used justifies the same. In any of the embodiments of FIG. 7 and FIGS. 15*a* and *b*, the web portion of the beams may readily be made to have a height of at least 50% of the total beam height, and more preferably at least ⅔ of the total beam height so as to particularly well facilitate a web mounting of the beam, similar to that illustrated in FIG. 14*c*.

What is claimed is:

1. An elongate structural member for building construction consisting of four members and comprising:

a pair of web members each having a center section that is substantially planar, each said web member having a height dimension that is substantially identical and each said center section having a height that is at least approximately fifty percent of said height dimension, each center section having first and second ends extending the length of said structural member, each center section having a leg extending at an acute angle from each of said ends, each pair of legs of each center section having an outer end and a flange mount extending from said respective outer end with said flange mounts of a said center section extending parallel to each other, said center sections being joined together directly and without any intermediate article at spaced apart locations along the length of said structural member with said flange mounts of said respective legs, which diverge from the corresponding ends of said respective center section, extending substantially in the same plane to define a respective first and a second mounting pair, a first and a second plate member, one of said plate members being attached to said first mounting pair of flange mounts extending in said same plane and the other of said plate members being attached to said second mounting pair of flange mounts extending in the respective same plane, each plate member having opposite side edges, said side edges of one of said plate members being bent toward said other plate member and said side edges of the other of said plate member being bent toward said one plate member, said plate members including said bent side edges having substantially the same width dimension with said width dimension being of such an extent that said bent side edges are spaced from said respective flange mounts.

2. The structural member of claim 1 wherein said first plate member and said second plate member are joined to said web members by spot welding.

3. The structural member of claim 1 wherein said first plate member and said second plate member are joined to said web members by continuous welds.

4. The structural member of claim 1 wherein said top plate member and said second plate member are thicker than said web members.

5. The structural member of claim 1 wherein said center web members are sheet metal.

6. The structural member of claim 1 wherein said first and second plate members are roll formed sheet metal.

7. The structural member of claim 1 wherein said first plate member has a shallow downward projecting channel roll formed therein.

8. An elongate structural member for building construction consisting of,four members and comprising:

a pair of web members each having a center section that is substantially planar, each said web member having a height dimension that is substantially identical and each said center section having a height that is at least approximately fifty percent of said height dimension, each center section having first and second ends extending the length of said structural member, each center section having a leg extending at an acute angle from each of said ends, each pair of legs of each center section having an outer end and a flange mount extending from said respective outer end with said flange mounts of a said center section extending parallel to each other, said center sections being joined together directly and without any intermediate article at spaced apart locations along the length of said structural member with said flange mounts of said respective legs, which diverge from the corresponding ends of said respective center section, extending substantially in the same plane to define a respective first and a second mounting pair, a first and a second plate member, one of said plate members being attached to said first mounting pair of flange mounts extending in said same plane and the other of said plate members being attached to said second mounting pair of flange mounts extending in the respective same plane, each plate member having opposite side edges, said side edges of one of said plate members being bent toward said other plate member and said side edges of the other of said plate members being bent toward said one plate member, said plate members including said bent side edges having substantially the same width dimension with said width dimension being of such an extent that said bent side edges are spaced from said respective flange mounts, said top plate member having an extending channel defined between said side bent edges of at least one of said plate members and said extending channel of said top plate member being adapted to receive a vertical stud member.

9. An elongate structural member for building construction consisting of four members and comprising:

a pair of web members each having a center section that is substantially planar, each said web member having a height dimension that is substantially identical and each said center section having a height that is at least approximately fifty percent of said height dimension, each center section having first and second ends extending the length of said structural member, each center section having a leg extending at an acute angle from each of said ends, each pair of legs of each center section having an outer end and a flange mount extending from said respective outer end with said flange mounts of a said center section extending parallel to each other, said center sections being joined together directly and without any intermediate article at spaced apart locations along the length of said structural member with said flange mounts of said respective legs, which diverge from the corresponding ends of said respective center section, extending substantially in the same plane to define a respective first and a second mounting pair, a first and a second plate member, one of said plate members being attached to said first mounting pair of flange mounts extending in said same plane and the other of said plate members being attached to said second mounting pair of flange mounts extending in the respective same plane, each plate member having opposite side edges, said side edges of one of said plate members being bent toward said other plate member and said side edges of the other of said plate members being bent toward said one plate member, said plate members including said bent side edges having substantially the same width dimension with said width dimension being of such an extent that said bent side edges are spaced from said respective flange mounts, said first plate member having said bent side edges defining an extending channel which is adapted to receive a wood member.

* * * * *